US009352487B2

(12) United States Patent
Foppe

(10) Patent No.: US 9,352,487 B2
(45) Date of Patent: May 31, 2016

(54) BLOCK MACHINE AND METHOD FOR VERTICALLY ADJUSTING A BLOCK MACHINE

(75) Inventor: Norbert Foppe, Spelle (DE)

(73) Assignee: Rekers Verwaltungs GmbH & Co. KG, Spelle (DE)

( * ) Notice: Subject to any disclaimer, the term of this patent is extended or adjusted under 35 U.S.C. 154(b) by 235 days.

(21) Appl. No.: 14/125,059

(22) PCT Filed: Jun. 4, 2012

(86) PCT No.: PCT/EP2012/060519

§ 371 (c)(1),
(2), (4) Date: Mar. 7, 2014

(87) PCT Pub. No.: WO2012/168195

PCT Pub. Date: Dec. 13, 2012

(65) Prior Publication Data

US 2015/0290836 A1 Oct. 15, 2015

(30) Foreign Application Priority Data

Jun. 9, 2011 (DE) ..... 10 2011 050 970

(51) Int. Cl.

| | |
|---|---|
| ***B28B 3/02*** | (2006.01) |
| ***B28B 15/00*** | (2006.01) |
| ***B28B 7/00*** | (2006.01) |
| ***B28B 1/04*** | (2006.01) |

(52) U.S. Cl.

CPC ..... *B28B 15/005* (2013.01); *B28B 1/04* (2013.01); *B28B 3/02* (2013.01); *B28B 7/0097* (2013.01); *B28B 15/00* (2013.01)

(58) Field of Classification Search

CPC ..... B28B 3/02; B28B 15/00
See application file for complete search history.

(56) References Cited

U.S. PATENT DOCUMENTS 3,078,540 A 2/1963 Bush
4,043,730 A * 8/1977 Bettonica ..... B28B 3/02 425/352

FOREIGN PATENT DOCUMENTS

EP 0382653 8/1990
NL 87631 10/1957

OTHER PUBLICATIONS

International Search Report, mailing date Oct. 1, 2012 for corresponding International Application No. PCT/EP2012/060519 with English translation.
International Preliminary Examination Report, mailing date Aug. 29, 2013 for corresponding International Application No. PCT/EP2012/060519.

* cited by examiner

*Primary Examiner* — James Mackey
(74) *Attorney, Agent, or Firm* — Intellectual Property Law Group LLP

(57) ABSTRACT

The invention relates to a block molding machine (1) comprising a bearing block (3) and a primary frame (2) which can be locked on the bearing block (3) in a vertically adjustable manner. At least one mold lifting device (19) for lifting and lowering a block mold (20) is provided on the primary frame (2). The primary frame (2) can be displaced relative to the bearing block (3) by actuating the mold lifting device (19) which is supported on the bearing block (3). The invention further relates to a method for vertically adjusting a block molding machine (1), comprising the following steps: displacing a mold lifting device (19) to a position (AS) supported on a bearing block (3); releasing a primary frame locking unit (9) for the primary frame (2); actuating the mold lifting device (19) such that the primary frame (2) is lifted; and applying the primary frame locking unit (9) for the primary frame (2).

20 Claims, 7 Drawing Sheets

BLOCK MACHINE AND METHOD FOR VERTICALLY ADJUSTING A BLOCK MACHINE

CROSS-REFERENCE TO RELATED APPLICATIONS

This application is a U.S. National Phase application, under 35 U.S.C. §371, of International Application no. PCT/EP2012/060519, with an international filing date of Jun. 4, 2012, and claims benefit of German Application no. 10 2011 050 970.4 filed on Jun. 9, 2011, and which are hereby incorporated by reference for all purposes.

FIELD OF THE INVENTION

The invention relates to a block machine and a method for vertically adjusting a block machine.

BACKGROUND

Block machines are known in the prior art in manifold embodiments. Substantially, in a synchronized process a mould should be provided, a concrete mixture should be filled into the moulding cavities of the mould, the concrete mixture should be packed with a tamper and/or a vibrator, and subsequently the moulded articles should be demoulded. Here, it has been proven successful to insert bolster pallets into the block machine and to lower upwards and downwards open moulds onto the bolster pallets. The concrete mixture is filled from a concrete hopper into a feedbox and let from the feedbox into the mould. Subsequently, the concrete is packed with a vibrator and a tamper pushing onto the concrete. In the next step the tamper and the mould are lifted and the bolster pallet with the moulded articles is taken out of the block machine.

With block machines various moulded stones can be produced. These can in particular differ also in height. So, for example concrete slabs are ca. 30 mm in height, whereas curbstones are ca. 300 mm in height. To be able to produce stones in different heights the block machine must be adjustable. Conventional block machines have a main frame with a vertically adjustable subframe arranged in its interior. Typically, for the vertical adjustment spindle drives are provided. These can be rotated to the desired height manually or with electric motors.

It has been shown that the spindle drive enables a very good adjustment. However, as a drawback it is considered that the adjustment of the height is associated with high expenditure of work, because after a vertical adjustment the subframe must be adjusted in the main frame with high effort. Moreover, the vertical adjustment with spindle drives is slow.

SUMMARY OF THE INVENTION

Against this background, it is the object of the invention to provide a block machine in which a vertical adjustment can be carried out in a simple and fast manner. Further, a method for vertically adjusting a main frame of a block machine should be provided.

The objective part of this problem is achieved with a block machine having the features of claim 1. Advantageous embodiments of the invention result from the dependent claims. The procedural part of the problem is achieved with a method having the features of claim 15.

The block machine has a bearing buck and a main frame which is vertically adjustable locatable on the bearing buck, wherein in particular on the main frame at least one mould lifting device for lifting and lowering a stone mould is provided. The main frame can be moved, in particular lifted or lowered, with respect to the bearing buck by actuating the mould lifting device supported on the bearing buck.

The bearing buck can be an arbitrarily designed supporting construction such as a bed, a lower frame, or the like, or a foundation.

That is, the device, already present, but intended for other purposes, for moving the mould is used to lift and lower, respectively, the entire main frame with the optionally present mounting parts with respect to the bearing buck and the bolster pallet. So, the subframe, the spindles, and spindle drives can be omitted, the machine becomes cheaper to manufacture and is easier to maintain, since less parts and drives, respectively, are present. Since the mould lifting device is already adjusted, moreover further adjustments can be saved after a vertical adjustment. A further advantage is that generally the mould lifting device can be moved relatively quickly, so that in total a vertical adjustment takes less time.

Preferably, the mould lifting device comprises at least one mould lifting cylinder and/or a mould traverse. By the mould traverse the device is stabilized such that lifting is possible with only one lifting cylinder. Also, a wider mould can be used. With a mould lifting cylinder, not only higher moulds can be quickly displaced over a larger lifting pathway, but according to the invention also the entire machine.

Suitable, the mould lifting device via at least one push-off block is supported with respect to the bearing buck. The use of a push-off block ensures that the mould lifting device and the bearing buck do not come into direct contact. This is advantageous to provide a lifting pathway of the mould lifting device for the normal production which is as large as possible on the one hand and not to have to additionally extend the lifting pathway of the moulding device to provide the lifting function for the main frame of the machine on the other hand. In this context, it may be provided that the push-off block is only inserted into the block machine if a vertical adjustment of the main frame is to be made.

Furthermore, at least one mould guiding bar can be provided that is coupled to the bearing buck and the main frame. The mould guiding bar serves to guide the mould lifting device. In this way, it is ensured that the orientation of the mould lifting device is always the same. This is particularly advantageous if several mould lifting cylinders are employed, since in general these cannot be actuated as uniform as it would be required for uniformly lifting the block machine.

It is particularly advantageous if the mould lifting device is located on the mould guiding bar. Then, the mould guiding bar is supported on the main frame and the bearing buck, respectively, via a movable bearing. It has been shown that a mould lifting device located on the mould guiding bars is not tilted.

Further, the main frame can be provided with a tamper lifting device for lifting and lowering at least one tamper. Preferably, the tamper lifting device comprises at least one tamper lifting cylinder and/or a tamper traverse.

Preferably, at least one tamper guiding bar is provided that is coupled to the bearing buck and the main frame. The tamper guiding bar is for holding the tamper lifting device and the tamper attached to the tamper lifting device in a constant orientation irrespective of the lifting position. In this way, a uniform contact pressure over the entire tamper contact surface is achieved.

It is particularly advantageous if also the tamper lifting device is located on the tamper guiding bar. Then, the tamper guiding bar is supported on the main frame and the bearing buck, respectively, via movable bearings. It has been shown that a tamper lifting device that can be moved along stationary tamper guiding bars like a slide due to the high forces acting and the partially non-uniform power flow tends to tilt. This is prevented by attaching the tamper lifting device to the tamper guiding bar.

Moreover, it can be provided that the mould lifting device is coupled to the tamper guiding bar and/or the tamper lifting device is coupled to the mould guiding bar. This mutual coupling increases the precision of the orientation also with a very high force application. In addition, this arrangement saves installation space.

Two mould guiding bars and two tamper guiding bars can be provided in parallel, with the mould guiding bars being arranged diagonally opposite. With this arrangement, wherein the mould guiding bars and the tamper guiding bars define edges of an imaginary cuboid, the tamper and/or the mould can be guided in a particular tilt-stable manner with a space-saving arrangement.

The mould guiding bar and/or the tamper guiding bar can be guided in the bearing buck and/or the main frame by at least one guiding unit. The guiding unit is a movable bearing. In the guiding unit a guiding bar is guided with high precision with low friction.

Further, it is suitable if the block machine has a main frame that can be vertically adjustable locatable on the bearing buck by at least one main frame locking unit. So, the main frame can be lowered with respect to the bearing buck by releasing the main frame locking unit.

The advantage of this solution can be seen in the fact that the lowering can be done particularly rapid, since the main frame must no longer be wind down via spindle drives. In turn, the mould lifting device can be used in lowering. Before the locking unit is released the mould lifting device can be moved such that it is supported on the bearing buck. This allows the main frame to be lowered in a controlled manner by retracting the lifting cylinder after the locking unit has been released. Once the main frame is at the desired height this height can be fixed by fastening the locking unit.

Preferably, the main frame can be located on at least one longitudinal guiding member, such as e.g. a tang or a shaft, of the bearing buck with the locking unit. Here, the tang has two functions. On the one hand, it ensures an accurate orientation of the main frame in the horizontal plane. On the other hand, it enables an accurate vertical adjustment of the main frame.

The method for vertically adjusting a block machine according to the invention comprises the steps of moving a mould lifting device into a position supported on a bearing buck; releasing a main frame locking unit for a main frame; actuating the mould lifting device such that the main frame is lifted; and fastening the main frame locking unit for the main frame.

The main frame locking unit can be formed as a clamping jaw.

BRIEF DESCRIPTION OF THE DRAWINGS

In the following, the invention is explained in more detail with the help of an example illustrated in the figures. Here.

DETAILED DESCRIPTION OF SPECIFIC EMBODIMENTS

Figure 1:
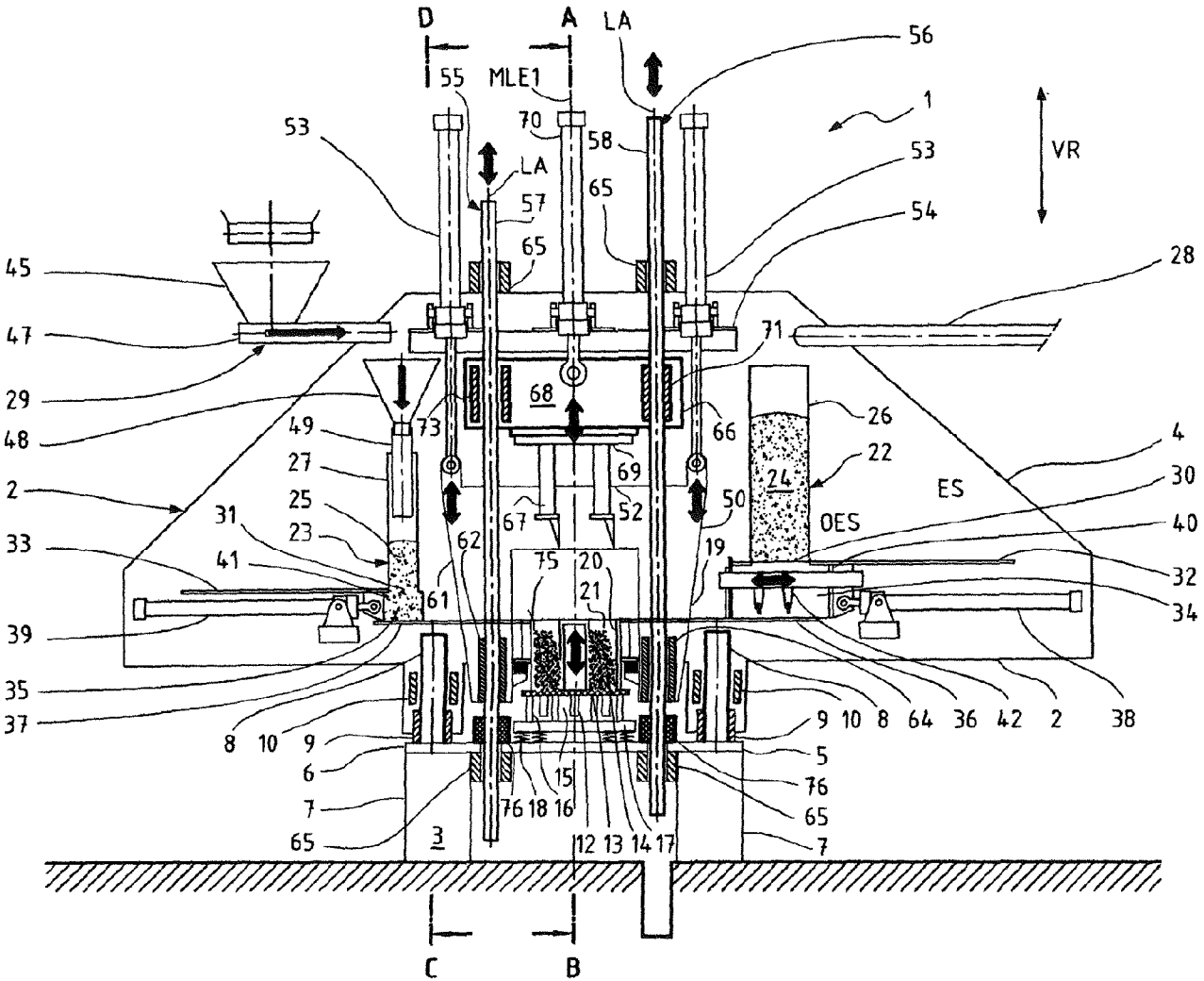
FIG. 1 shows a side view of the block machine according to the invention in the production process with a lifted tamper lifting device.
Figure 2:
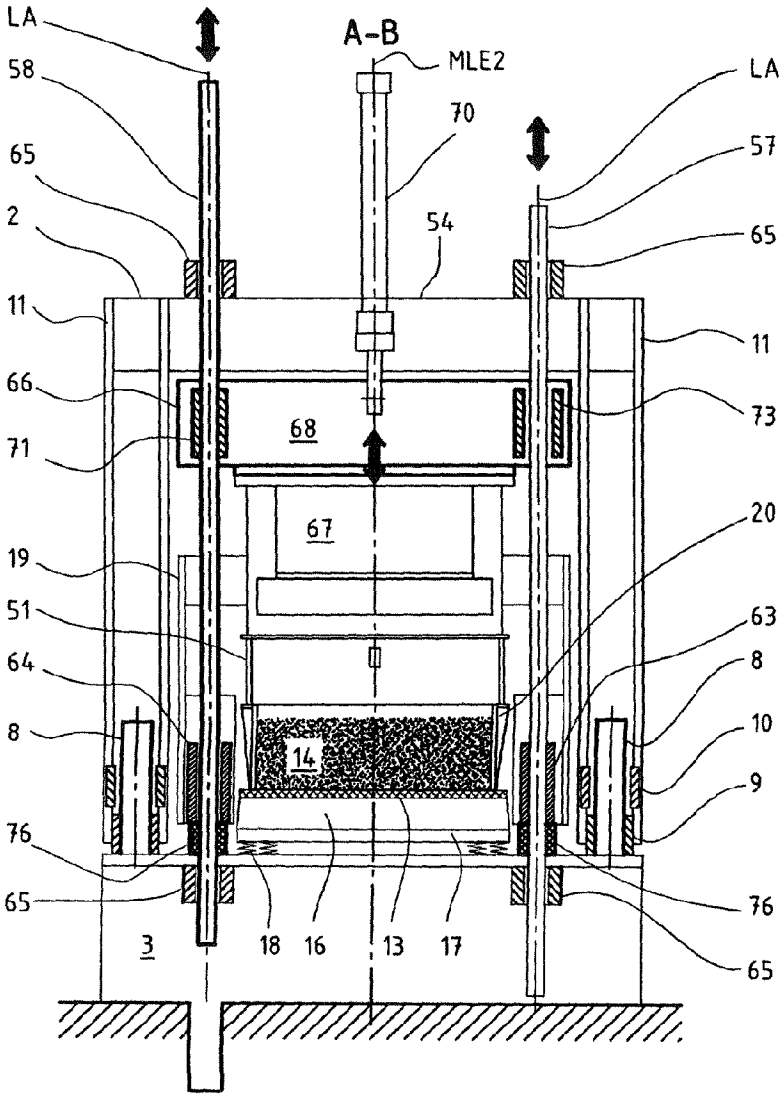
FIG. 2 shows a sectional view along line A-B in FIG. 1.
Figure 3:
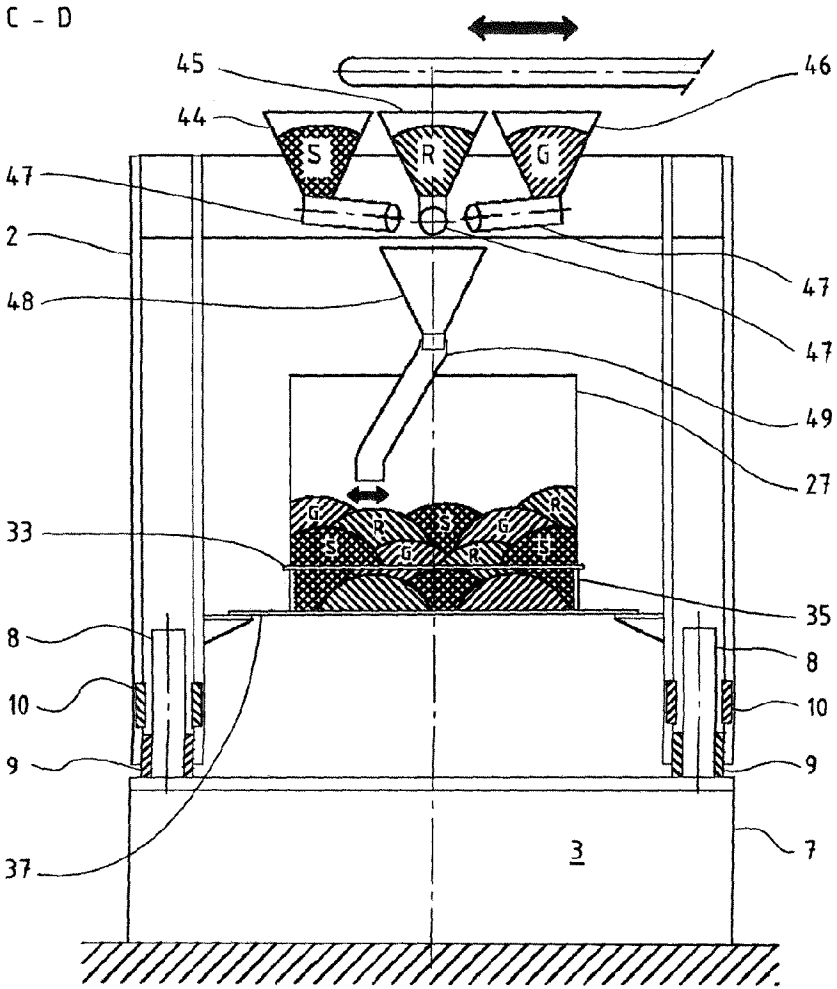
FIG. 3 shows a sectional view along line C-D in FIG. 1.

In FIGS. 1 to 7, there is shown an embodiment of the block machine 1 according to the invention in several views and operating stages. The block machine 1 comprises a main frame 2 supported on a bearing buck 3. Main frame 2 and bearing buck 3 together are referred to as bed 4. In the example shown the bearing buck 3 has a rectangular platform 5 with legs 7 in the form of rectangular tubes. However, basically the legs 7 can also be designed in any other way.

Figure 4:
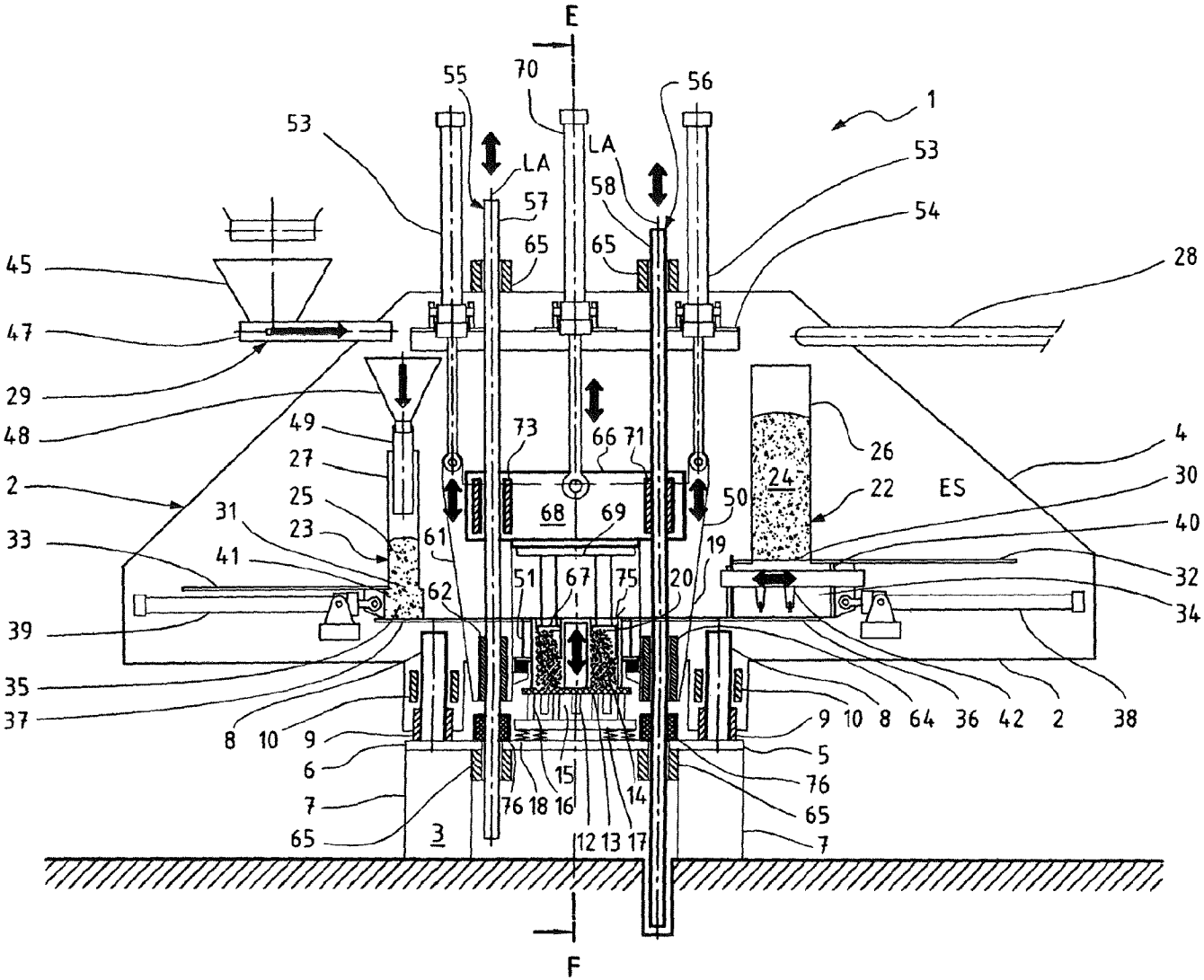
FIG. 4 shows a side view of the block machine according to the invention of FIG. 1 in the production process with a lowered tamper lifting device.
Figure 5:
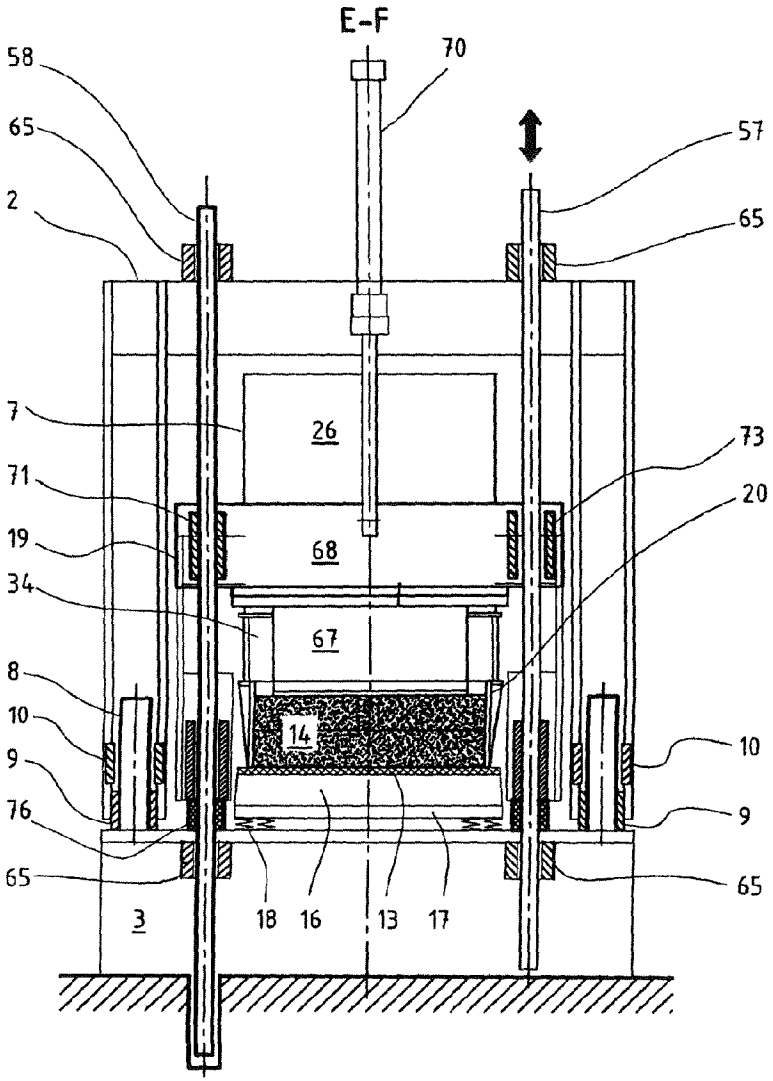
FIG. 5 shows a sectional view along line E-F in FIG. 4.
Figure 6:
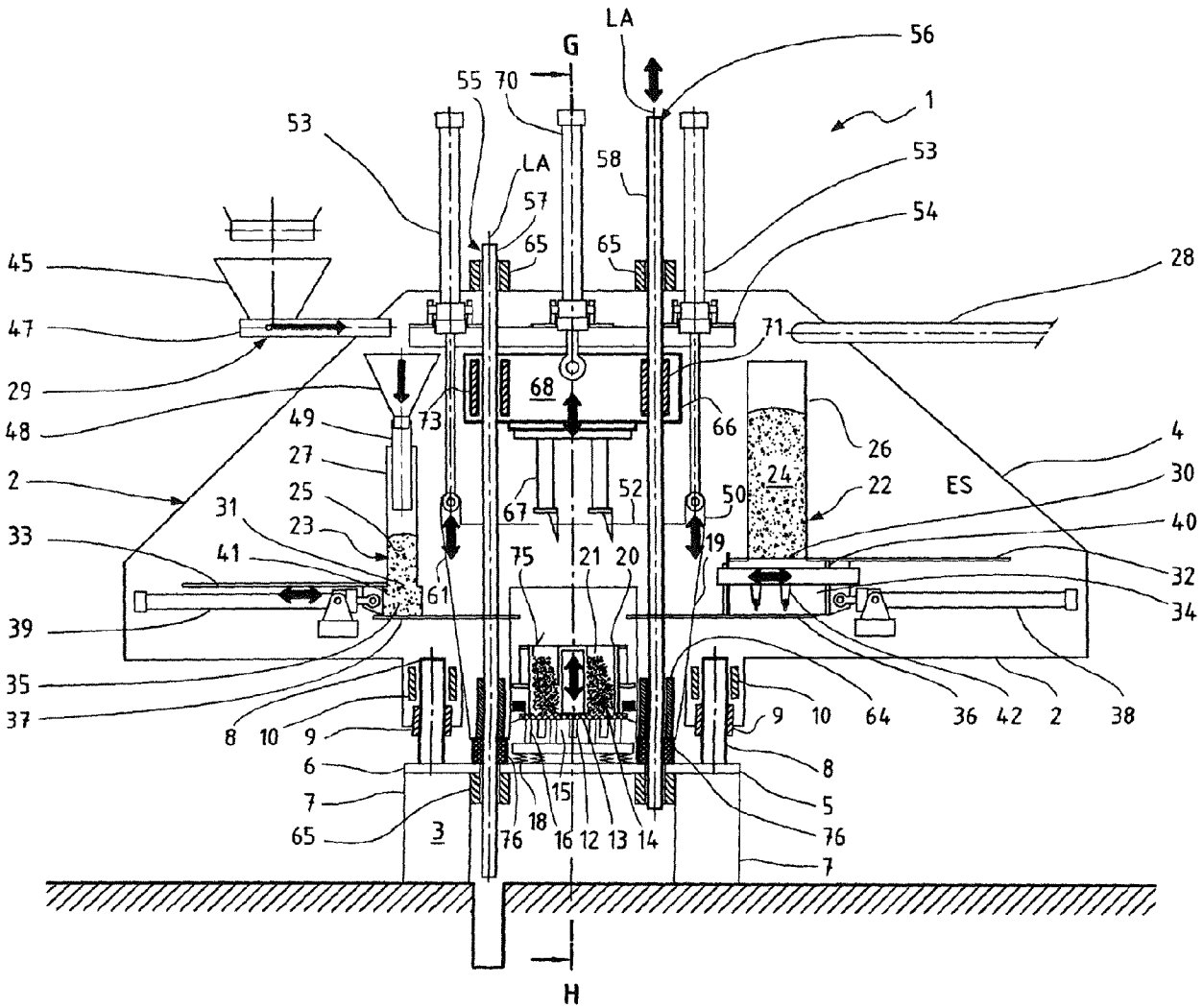
FIG. 6 shows a side view of the block machine according to the invention of FIG. 1 during lifting of the main frame.
Figure 7:
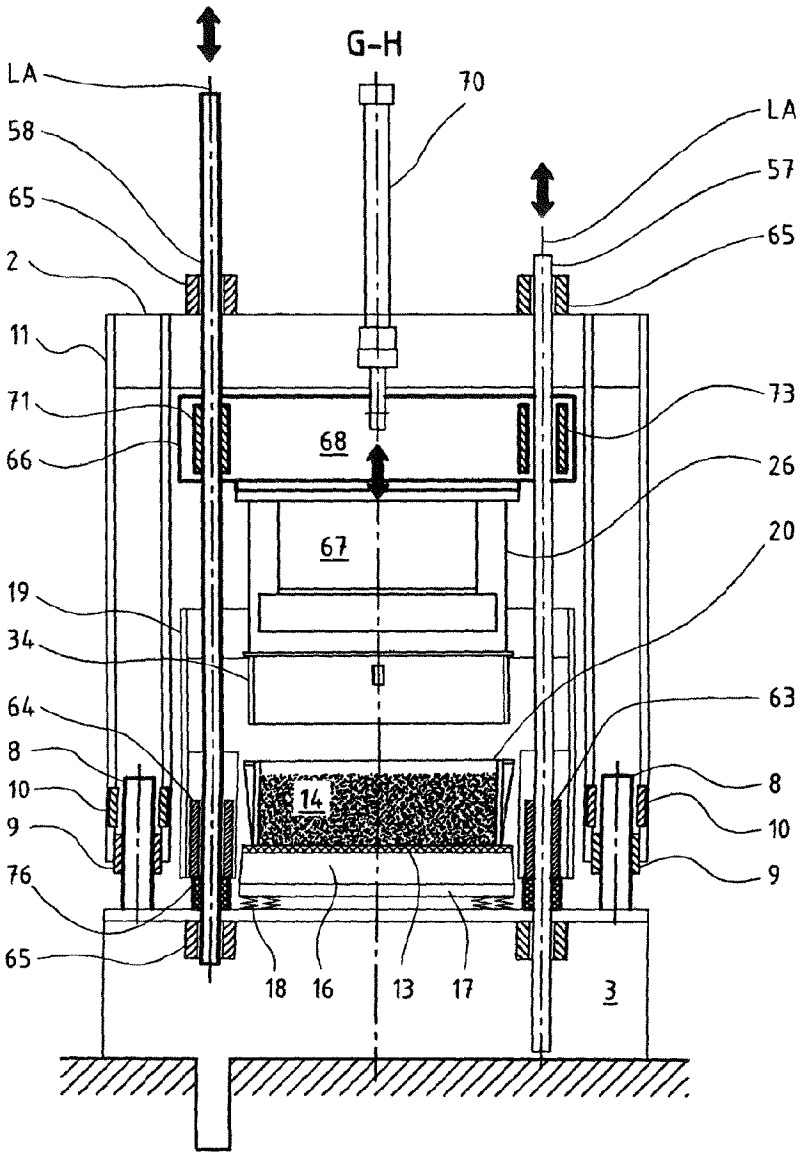
FIG. 7 shows a sectional view along line G-H in FIG. 6.

From platform 5 there extend four longitudinal guiding units in the form of tangs 8 in a vertical direction VR upwards on which the main frame 2 is guided and vertically adjustable locatable. For that, on the part of the main frame 2 a main frame locking unit 9 and a main frame guiding unit 10 are assigned to each tang 8. The main frame 2 is a frame construction from profiles 11 being welded with each other. In the illustrations of FIGS. 1, 4, and 6 the main frame 2 is trapezoidal and in the side views of FIGS. 2, 3, 5, and 7 it is rectangular.

To the bearing buck 3 and the main frame 2 several devices are attached. The bearing buck 3 is provided with longitudinal beams 12. The longitudinal beams 12 are also referred to as static bridge. In the interspaces 15 between the longitudinal beams 12 lands 16 of a vibrator table 17 are arranged onto which bolster pallets 13 can be pushed in a synchronized manner. On the bolster pallets 13 the moulded articles 14 are produced. The vibrator table 17 is supported on the bearing buck 3 by spring members 18. Onto the bolster pallet 13 a downwards and upwards open stone mould 20 (in short: mould) can vertically be lowered from above with a mould lifting device 19. Moulds 20 are available in various types to present a wide range of production. For example, there are moulds 20 for stone slabs, paving blocks, hollow blocks, and curbstones. Generally, the moulds 20 have several mould cavities 21 for several moulded articles 14.

The mould cavities 21 can be filled with a concrete mixture 24, 25 by concrete filling devices 22, 23. For that, the machine shown is provided with two concrete filling devices 22, 23 the first of which fills a so-called coarse mix 24 and the other serves to apply a facemix 25 as a top layer onto a layer of coarse mix 24. The concrete filling devices 22, 23 each have a concrete hopper 26, 27 that can be filled with the concrete mixture 24, 25 by concrete supplies 28, 29. The coarse mix hopper 26 has a larger volume than the facemix hopper 27. The bottoms 30, 31 of the concrete hoppers 26, 27 each are provided with a closing sheet 32, 33. The concrete mixture 24, 25 can be passed from the concrete hopper 26, 27 into a feedbox 34, 35. The feedbox 34, 35 is upwards and downwards open. A table board 36, 37 forms the bottom for the concrete mixture 24, 25 in the feedbox 34, 35. The feedbox 34, 35 can be displaced with a hydraulic cylinder 38, 39 on the table board 36, 37 attached to the main frame 2. When the feedbox 34, 35 is moved in the direction of the mould 20 the feedbox 34, 35 pulls the closing sheet 32, 33 attached thereto into a position that closes the concrete hopper 26, 27 via supporting members 40, 41. In the feedbox 34 for the coarse mix 24 an oscillating grid 42 is arranged to uniformly fill the coarse mix 24 into the mould cavities 21. After the concrete mixture 24, 25 has been filled into the mould cavities 21 the feedbox 34, 35 again is pulled back into the retracted position ES with the hydraulic cylinder 38, 39. In the retracted position ES of the feedbox 34, 35 the closing sheet 32, 33 can be pulled into a position that opens the concrete hopper 26, 27 OES.

In the embodiment shown, the block machine can process differently colored facemixes. For that, the concrete filling device 23 for the facemix 25 has three filling funnels 44-46. These can stock facemixes 25 of different colors such as black S, red R, and yellow G. By the conveyor units 47 the facemix 25 can be conveyed from the filling funnels 44-46 to a funnel 48 from which it can be introduced into the hopper 27 for the facemix 25 by a horizontally movable tube 49.

The mould 20 can be lowered onto the bolster pallet 13 with a mould lifting device 19 and, after filling the mould cavities 21 with concrete mixture 24, 25 and its packing, lifted again to demould the moulded articles 14. The mould lifting device 19 comprises a mould traverse 50 with a mould fixture 51 for a mould 20. The mould traverse 50 in the side view of FIGS. 1, 4, and 6 is U-shaped. At the upper transverse land 52 of the mould traverse 50 two mould lifting cylinders 53 laterally touch. The mould lifting cylinders 53 are attached to the main frame 2 via a console 54. In order to ensure an accurate orientation of the mould lifting device 19 the mould traverse 50 is coupled with first guides 55 consisting of two vertical guiding bars 57 and second guides 56 consisting of two vertical guiding bars 58. The guiding bars 57, 58 with respect to their longitudinal axes LA are parallel to each other and assigned to one of the four edges 61 of the mould traverse 50 each. The mould lifting device 19 is firmly connected to two diagonally opposite guiding bars 57, the mould guiding bars 57, especially via the locking units 62, 63. The mould traverse 50 can slide along the two remaining guiding bars 58. These guiding bars 58 are guided in the mould traverse 50 by a guiding unit 64. The guiding bars 57, 58 with the bed 4 are vertically movable coupled to the main frame 2 and the bearing buck 3 via movable bearings 65.

After the concrete mixture 24, 25 has been filled into the mould cavities 21 the concrete mixture 24, 25 is packed. For that, the bolster pallet 13 is vibrated with the vibrator table 17. Subsequently, one or more tampers 67 are lowered with a tamper lifting device 66, cf. especially FIGS. 4 and 5. The tamper lifting device 66 comprises a tamper traverse 68. The tamper traverse 68 has a tamper fixture 69 for interchangeably receiving the tampers 67. The tamper traverse 68 is moved by a centrally arranged tamper lifting cylinder 70. Also, the tamper lifting cylinder 70 is attached to the main frame 2 via the console 54. The tamper traverse 68 is coupled to the second guides 56 consisting of two guiding bars 58 and the first guides 55. The two diagonally opposite guiding bars 58 that are no mould guiding bars 57 are referred to as tamper guiding bars 58, because they are attached to the tamper traverse 68 via the locking units 71. The tamper traverse 68 can slide along the mould guiding bars 57 via the guiding units 73.

The mould lifting device 19, the tamper lifting device 66, and the guiding bars 57 with respect to two longitudinal center planes MLE1, MLE2 are doubly symmetric.

In order to lift the level of the table board 36, 37 with respect to the bolster pallet 13 to the height of the upper edge 75 of the mould 20 the main frame 2 can be displaced in height. To lift the main frame 2 the mould traverse 50 is displaced downwards until it is supported on the bearing buck 3 by four push-off blocks 76 assigned to the guiding bars 57, 58, in particular surrounding the guiding bars 57, 58. Further extension of the mould lifting cylinder 53 of the mould lifting device 19 results in lifting the main frame 2 with all mounting parts. Before and after the lifting the main frame locking units 9 have to be released or fastened, respectively. Lowering the main frame 2 in the simplest case can be done by the controlled release of the main frame locking units 9. The lowering can be promoted by the mould lifting device 19 by moving the mould traverse 50 into a position AP that is supported on the bearing buck 3 before the main frame locking units 9 are released and by retracting the mould lifting cylinder 53 after release. After the desired height has been achieved the main frame 2, via the main frame locking units 9, is located on the tangs 8 of the bearing buck 3 with the main frame locking unit 9.

REFERENCE NUMBERS

1-Block Machine
2-Main Frame
3-Bearing Buck
4-Bed
5-Platform
6-Edges
7-Leg
8-Tang
9-Main Frame Locking Unit
10-Main Frame Guiding Unit
11-Profile
12-Longitudinal Beams
13-Bolster Pallet
14-Moulded Article
15-Interspace
16-Land
17-Vibrator Table
18-Spring Member
19-Mould Lifting Device
20-Stone Mould
21-Mould Cavity
22-Concrete Filling Device
23-Concrete Filling Device
24-Coarse Mix
25-Facemix
26-Concrete Hopper
27-Concrete Hopper
28-Concrete Supply
29-Concrete Supply
30-Bottom
31-Bottom
32-Closing Sheet
33-Closing Sheet
34-Feedbox
35-Feedbox
36-Table Board
37-Table Board
38-Hydraulic Cylinder
39-Hydraulic Cylinder
40-Supporting Member
41-Supporting Member
42-Grid
44-Filling Funnel
45-Filling Funnel
46-Filling Funnel
47-Conveyor Unit
48-Funnel
49-Tube
50-Mould Traverse
51-Mould Fixture
52-Transverse Land
53-Mould Lifting Cylinder
54-Console
55-First Guide
56-Second Guide

57-Guiding Bar
58-Guiding Bar
61-Edge
62-Locking Unit
63-Locking Unit
64-Guiding Unit
65-Movable Bearing
66-Tamper Lifting Device
67-Tamper
68-Tamper Traverse
69-Tamper Fixture
70-Tamper Lifting Cylinder
71-Locking Unit
73-Guiding Unit
75-Upper Edge
76-Push-off Block
AP-Supported Position
ES-Retracted Position
G-Yellow
LA-Longitudinal Axis of 57, 58
MLE1-Longitudinal Center Plane 1
MLE2-Longitudinal Center Plane 2
OES-Opening Position
R-Red
S-Black
VR-Vertical Direction

What is claimed is:

1. A block machine with a bearing buck (3) and a main frame (2) which is vertically adjustable locatable on the bearing buck (3), wherein at least one mould lifting device (19) for lifting and lowering a stone mould (20) is provided on the main frame (2), wherein the main frame (2) is movable with respect to the bearing buck (3) by actuating the mould lifting device (19) that is supported on the bearing buck (3).

2. The block machine according to claim 1, characterized in that the mould lifting device (19) comprises at least one mould lifting cylinder (53) and/or a mould traverse (50).

3. The block machine according to claim 1, characterized in that the mould lifting device (19) is supported on the bearing buck (3) by at least one push-off block (76).

4. The block machine according to claim 1, characterized in that at least one mould guiding bar (57, 58) is provided that is coupled to the bearing buck (3) and the main frame (2).

5. The block machine according to claim 4, characterized in that the mould lifting device (19) is located on the mould guiding bar (57).

6. The block machine according to claim 1, characterized in that a tamper lifting device (66) for lifting and lowering at least one tamper (67) is provided on the main frame (2).

7. The block machine according to claim 6, characterized in that the tamper lifting device (66) comprises at least one tamper lifting cylinder (70) and/or a tamper traverse (68).

8. The block machine according to claim 6, characterized in that at least one tamper guiding bar (58) is provided that is coupled to the bearing buck (3) and the main frame (2).

9. The block machine according to claim 8, characterized in that the tamper lifting device (66) is located on the tamper guiding bar (58).

10. The block machine according to claim 4, characterized in that the mould lifting device (19) is coupled to a tamper guiding bar (58) and/or a tamper lifting device (66) is coupled to the mould guiding bar (57).

11. The block machine according to claim 8, characterized in that a first mould guiding bar, a second mould guiding bar (57) and two tamper guiding bars (58) in parallel are provided, wherein the first mould guiding bar is arranged diagonally opposite to the second mould guiding bar.

12. The block machine according to claim 4, characterized in that the mould guiding bar (57) and/or a tamper guiding bar (58) are guided in the bearing buck (3) and/or in the main frame (2) by at least one guiding unit (65).

13. The block machine according to claim 1, characterized in that the main frame (2) with respect to the bearing buck (3) can be lowered by releasing a main frame locking unit (9).

14. The block machine according to claim 13, characterized in that the main frame (2) can be located on at least one longitudinal guiding unit (8) of the bearing buck (3) with the main frame locking unit (9).

15. The block machine according to claim 2, characterized in that the mould lifting device (19) is supported on the bearing buck (3) by at least one push-off block (76).

16. The block machine according to claim 2, characterized in that at least one mould guiding bar (57, 58) is provided that is coupled to the bearing buck (3) and the main frame (2).

17. The block machine according to claim 3, characterized in that at least one mould guiding bar (57, 58) is provided that is coupled to the bearing buck (3) and the main frame (2).

18. The block machine according to claim 15, characterized in that at least one mould guiding bar (57, 58) is provided that is coupled to the bearing buck (3) and the main frame (2).

19. The block machine according to claim 2, characterized in that the mould lifting device (19) is located on a mould guiding bar (57).

20. A method for vertically adjusting a block machine (1), characterized by the following steps:

moving a mould lifting device (19) into a position supported on a bearing buck (3);

releasing a main frame locking unit (9) for a main frame (2);

actuating the mould lifting device (19) such that the main frame (2) is lifted; and fastening the main frame locking unit (9) for the main frame (2).

* * * * *